US005229535A

United States Patent [19]

Kozuki et al.

[11] Patent Number: 5,229,535

[45] Date of Patent: Jul. 20, 1993

[54] ELECTRONIC MUSICAL INSTRUMENT WITH A FILTER DEVICE HAVING A RELAY

[75] Inventors: Koichi Kozuki; Tetsuji Ichiki; Kazuhisa Okamura, all of Hamamatsu, Japan

[73] Assignee: Yamaha Corporation, Hamamatsu, Japan

[21] Appl. No.: 842,048

[22] Filed: Feb. 26, 1992

[30] Foreign Application Priority Data

Mar. 1, 1991 [JP] Japan ..... 3-036430

[51] Int. Cl.[5] ..... G10H 1/057; G10H 1/12

[52] U.S. Cl. ..... 84/661; 84/663; 84/DIG. 9

[58] Field of Search ..... 84/622-627, 84/661, 663, 699, 700, 702, 703, 736, 738, DIG. 9

[56] References Cited

U.S. PATENT DOCUMENTS 4,815,354 3/1989 Kunimoto ..... 84/DIG. 9

*Primary Examiner*—Stanley J. Witkowski

*Attorney, Agent, or Firm*—Spensley Horn Jubas & Lubitz

[57] ABSTRACT

A musical tone generating apparatus generates musical tones based on a signal outputted from a sound source and an envelope generator. The signal outputted from the sound source is processed by a digital filter in accordance with filter information responsive to a key-on signal. Filter information generating circuit generates delay time information corresponding to the time period which the digital filter needs to process and output an inputted data. The envelope is imparted to the signal outputted from the sound source with a delay from a key-on timing which corresponds to the delay time information to realize precise envelope rise portions.

9 Claims, 4 Drawing Sheets

ELECTRONIC MUSICAL INSTRUMENT WITH A FILTER DEVICE HAVING A RELAY

BACKGROUND OF THE INVENTION

1. Field of the Invention

The present invention relates to a musical synthesis device, and in particular to an electronic musical instrument provided with a filter device having a delay time.

2. Prior Art

Electronic musical instruments of a type which form a musical signal according to the performance information received from a player's performance, and which generate a a musical tone from a musical signal in response to the performance from a keyboard, etc. are already known. In this type of electronic musical instrument, a musical tone having a variety of tone colors is formed as a result of the filtering of the musical signals which have been formed based on performance information, and from the provision of the desired envelope.

However, in the electronic musical instruments already known, because the filter itself is a simple device, and the delay time included in the complete filter system is of a comparatively short unit, no consideration was given to obtaining a time delay through the filter.

Recently, however, accompanying the desire to obtain a high quality musical tone, there has been a demand for more complicated filter characteristics. For this reason, it has become impossible to ignore the time delay of the filter system. Furthermore, in electronic musical instruments of the aforementioned type, although it is possible for the performer to vary the character of a complicated filter, because not enough attention was paid to the filter characteristics which vary in this manner, it has not been possible to compose true musical tones for the rise portion of a musical tone.

SUMMARY OF THE PRESENT INVENTION

Taking into consideration the above circumstances, it is the object of the present invention to provide an electronic musical instrument which can control the rise of an envelope signal in response to the filter characteristics, and which can synchronize the envelope signal and the digital signal outputted from the filter.

In order to solve the problems detailed above which have been encountered in the prior art, the present invention is characterized by the provision of the following special features: a musical signal generating means, which forms a set musical signal in response to performance information; a filter means, having a fixed character and providing fixed characteristics to the musical signal; a filter information generating means, which forms filter information for establishing the fixed character based on the performance information, and which supplies this information to the filter means; a delay information generating means, which generates delay information related to the delay time from the time point at which the musical signal, based on filter information, is provided by the filter means, until the time at which the characterized signal has been outputted; an envelope generating means which generates an envelope in which the rise period has been controlled based on the delay information; and, an envelope provision means for providing an envelope to a characterized musical signal.

A set musical signal is formed by the musical signal composing means in response to performance information. Furthermore, in response to performance information, the filter information for setting the character of the filter, is formed by the filter information generating means. The musical signal is filtered by the filter means which has an established character set based on the filter information. Furthermore, delay information relating to the delay time from when the musical signal is provided by the filter means to when the characterized signal is outputted is formed by the delay information generating means. Next, an envelope in which the rise cycle is controlled based on the delay information is generated by the envelope generating means based on the aforementioned delay information. Additionally, an envelope is provided to a filtered musical signal by the envelope provision means.

As explained above, the present invention provides an advantage in that it is possible to control the rise of the envelope signal in response to the filter characteristics, and carry out the synthesis of the true tone of the rising portion of a musical tone.

DETAILED DESCRIPTION OF THE PREFERRED EMBODIMENTS

Figure 1:
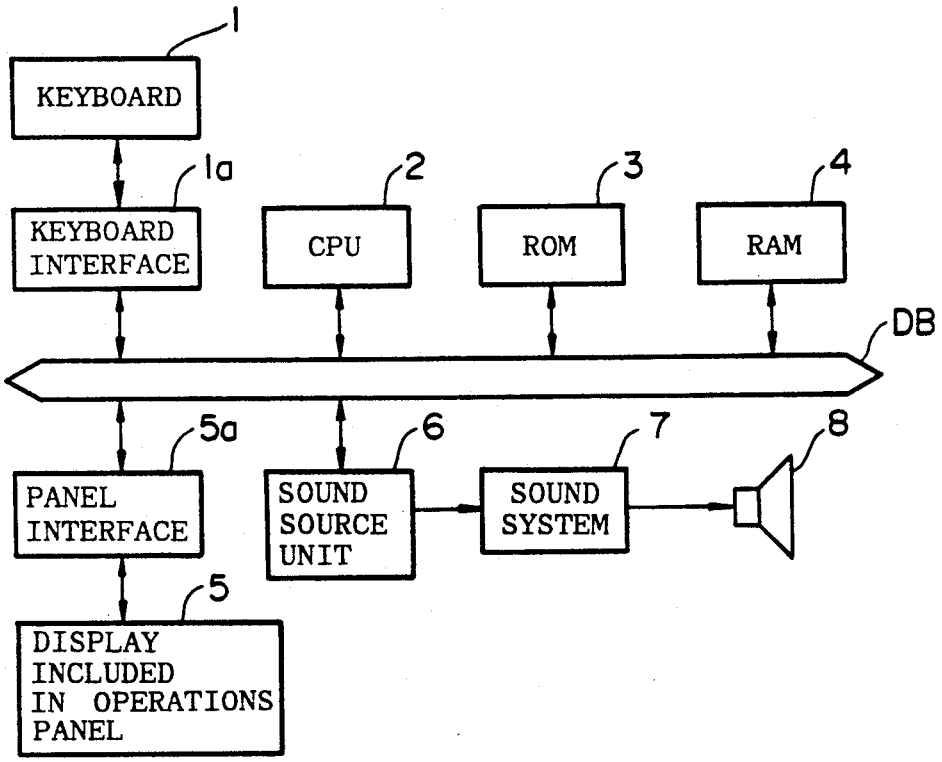
FIG. 1 is a block diagram showing the entire structure of an electronic musical instrument in the preferred embodiment of the invention of the present application.

With reference to the accompanying drawings, preferred embodiments of the present invention will be described in detail hereinafter. FIG. 1 is a block diagram showing the structure of an embodiment of the present invention. In FIG. 1, keyboard 1 is provided with, for example, 76 black and white keys. Keyboard interface 1*a* scans the condition of the point of contact of keyboard 1, detects the speed, key code corresponding to designated pitch, etc., of the depressed key, and provides this performance information to CPU 2 (Central Processing Unit). This CPU 2 controls the actions of the entire electronic musical instrument. All types of parameters necessary to the electronic musical instrument, the program of the CPU 2, etc., are stored in ROM 3 (Read Only Memory). Additionally, RAM 4 (Random Access Memory) is utilized as a temporary storage area for the CPU 2 register and data. In the same manner as a regular electronic musical instrument, operation panel 5 is provided with a tone color switch, a power source switch, a volume switch and the like. In addition, a display is provided to show the status (the number of the tone color selected, etc.) within the electronic musical instrument. Next, panel interface 5*a* carries out the scanning of the switches which are provided in operation panel 5 and executes control of the display. Sound source unit 6 generates the musical tones of the 16 musical tones according to time sharing operations based on the musical tone information provided from CPU 2. The aforementioned circuit operates in a predetermined time sharing manner, by means of synchronized timing. Additionally, sound system 7 converts the digital musical signal, which is outputted from sound source unit 6, to an analog signal and, following amplification, generates musical tones from speaker unit 8. Furthermore, databus DB mutually transmits the data outputted from each of the above means.

Figure 2:
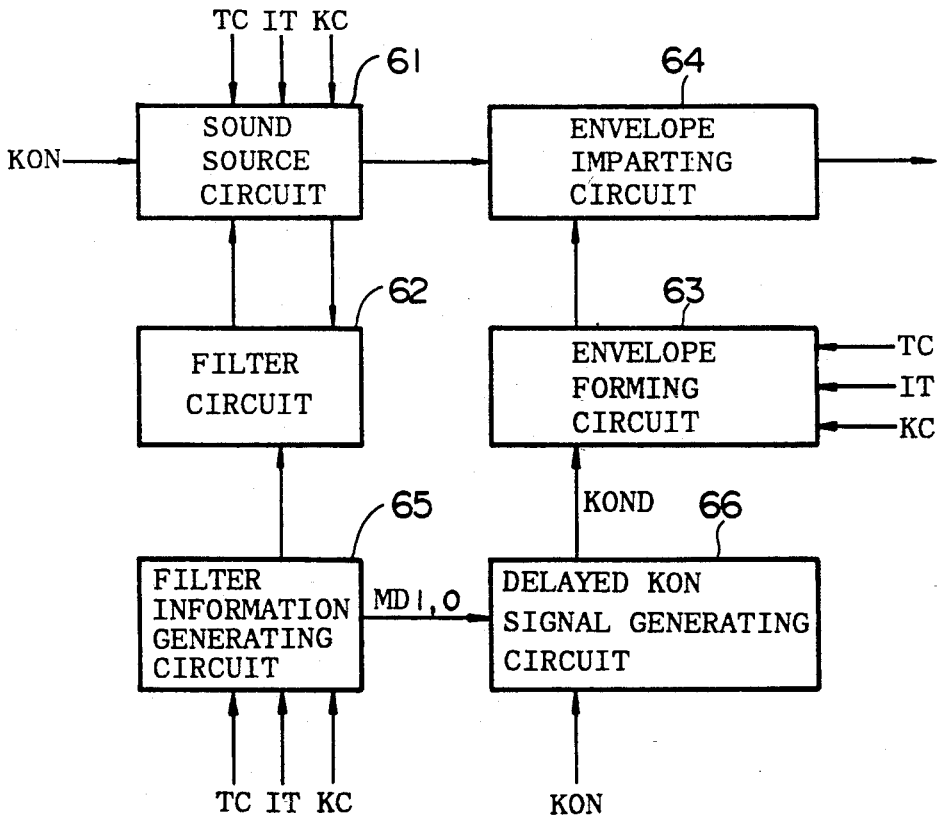
FIG. 2 is a block diagram showing the inner portion of the sound source unit of the preferred embodiment.

Next, with reference to the block diagram shown in FIG. 2, the detailed structure of the above sound source unit 6 will be explained. When the key-on signal KON has a status of "1", the sound source circuit 61 forms a digital musical signal according to information such as the tone color number TC, the initial touch information IT, and the key code KC, and then supplies this signal to filter circuit 62. Following provision of the desired filter characteristics to the digital musical tone signal according to the filter coefficient, filter circuit 62 then provides this digital musical tone signal to envelope imparting circuit 64 by way of sound source circuit 61. Because this filter circuit 62 is constructed utilizing a delay, it possesses delay characteristics. Furthermore, as will be put forth later, from the relation to the actual filter coefficient, the current signal is essentially reflected, and the obtainment of the realized desired filter characteristics takes place later, following the input of the signal and after some time (corresponding to sampling time) has elapsed. Next, filter information generating circuit 65 generates an MD signal and a filter coefficient according to the information such as the tone color number TC, the initial touch information IT, and the key code KC. Filter information generating circuit 65 provides this filter coefficient to filter circuit 62, while at the same time providing delay time control information MD 0,1 (2 bit information) corresponding to the filter coefficient to delay KON signal generating circuit 66. According to the delay time control information MD 0,1 corresponding to the filter coefficient, delay key-on KON signal generating circuit 66 generates a delay key-on signal KOND as a delayed key-on signal KON corresponding to the delay time of filter circuit 62. This is then supplied to envelope forming circuit 63. As a result of this, key-on signal KON is provided to envelope forming circuit 63 as a KOND signal which is delayed by the delayed time of filter circuit 62. When the status of the delay key-on signal KOND is "1", envelope forming circuit 63 forms an envelope corresponding to the information such as the tone color number TC, the initial touch information IT and the key code KC, and supplies this envelope to envelope imparting circuit 64. Envelope imparting circuit 64, for example, contains the multiplier and provides an output of a predetermined envelope to a musical signal by multiplying the digital musical sound by the delayed envelope.

In this manner, in order to prevent a multiplication of an envelope signal with signal outputted from the sound source circuit 61 before the musical tone data is accumulated, this being necessary for a rise of the subsequent envelope, the delay time corresponding to the delay time of filter circuit 62 is provided to the rise timing of the envelope signal to synchronize the envelope with the musical tone data.

Figure 3:
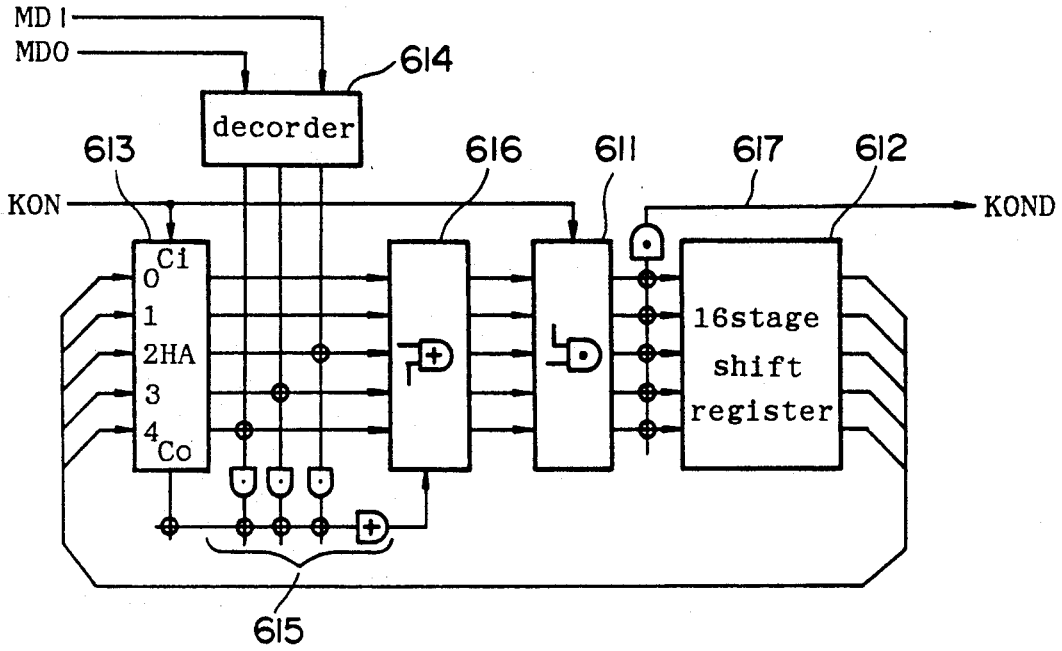
FIG. 3 is a circuit diagram showing the details of the delayed_KON signal generating circuit of the sound source unit shown in FIG. 2.

Next, with reference to the block diagram shown in FIG. 3, the structure of the aforementioned delayed_ KON signal generating circuit 66 will be explained in detail. In FIG. 3, AND circuitry group 611 operates as a gate which, by a KON signal, passes the data for time sharing corresponding to the 16 stage internal shift register 612. In other words, the key-on signal KON is supplied to an input terminal of each of the AND circuits. When the key-on signal KON is "0", the output from each AND circuit becomes "0" and the gate is closed. When the key-on signal KON is "1", all AND circuits acquire an "open" status, and (repeat)-data supplied to another input terminal is outputted to shift register 612. The data within shift register 612 is comprised so as to operate by means of 16 channel time sharing. The data is supplied to a half adder 613 at each time sharing division. At the channels which have been placed in a key-on state, because the key-on signal KON which was provided to the input terminal Ci has become "1", the data of the aforementioned channels are incremented one by one, and then provided to half adder 613 as 5 bit data. Half adder 613 adds the 5 bit data and the key-on signal KON provided to carry-in terminal Ci. In other words, during key depression, in order for a status of "1" to be acquired, key-on signal KON is added to the above 5 bit data by means of 16 channel time sharing. Additionally, delay time control information MD 0,1, which was received from the filter information generating circuit 65 shown in FIG. 2, is provided to decoder 614. Decoder 614 decodes (sets) delay quantity control information MD 0,1 to a 3 bit target data, and supplies this target data to comparator 615. Comparator 615 compares the command to the above data which flows through the loop comprised from the shift register 612, half adder 613, etc. In the case where the data has reached the target data, one input terminal of all of the OR circuits of OR circuitry group 616 becomes "1". When each input terminal becomes "1", or in other words when the repeat data and the target data are identical, the status of the OR circuitry group 616 becomes open. The OR circuitry then outputs "1" at all bits regardless of the repeat data received from another input terminal, and supplies this to the AND circuitry group 611. Furthermore, AND circuit 617 sets the output data of the AND circuit group 611 (in other words all of the bits of the repeat data which have been set to "1"), and the delay key-on signal KOND, which is this output signal, to "1". At the delayed _KON signal generating circuit 66, when the key-on signal KON is initially received, the data is set to 0 and incremented by half adder 613. When this data reaches the target data given by the decoder, a delay key-on signal KOND is generated through the setting of all the bits to "1" by OR circuitry group 616. After all bites have become 1, "1" is added at the half adder 613. All of the bits of the data become "0" and, because the carry-out signal Co is outputted at the next timing, all the bit outputs from OR circuitry group 616 are set to 1. Additionally, when the delay time control information MD 0,1 is [0,0], in this example, assuming that a bit within the bits of the decoded target data and corresponding to the 5 bit repeat data becomes "1", at the point in time when the fifth bit of the above data becomes "1", the gate of the OR circuitry group becomes "open" for the first time and the delay key-on signal KOND is outputted. Additionally, for example, when the delay time control information MD 0,1 is [1,1], until all the third to fifth bits of the repeat data have become "1", the delay key-on signal KOND is not outputted. In this manner, the delay time of the delay key-on signal KOND changes according to the status of the delay time control information MD 0,1. Delay time control information MD 0,1 responds to the delay time of the above delay key-on signal KOND so that the filter ratio becomes a value corresponding to the filter ratio.

In this manner, according to the relationship between the filter ratio and the delay time, given the composition of the logic circuit of decoder 614 or comparator 615, it is possible to obtain a delay time which corresponds to the filter characteristics. In other words, in response to the key-on signal KON, following a delay of the time set only, the delay key-on signal KOND is generated.

Figure 4:
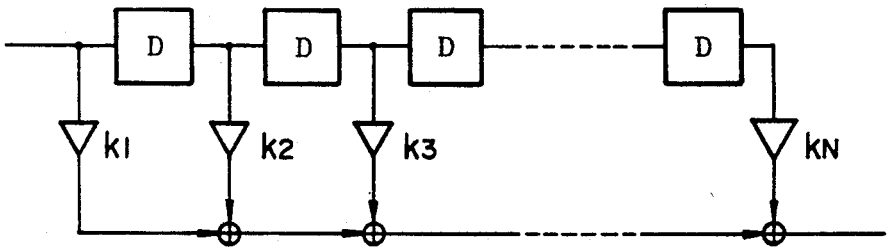
FIG. 4 is a block diagram showing an example of an FIR filter.
Figure 5:
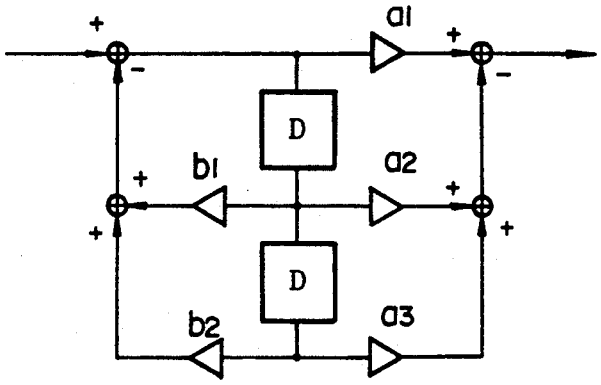
FIG. 5 is a block diagram showing an example of an IIR filter.

FIG. 4 is an example of an FIR type digital filter. FIG. 5 is an example of the secondary IIR type digital filter. As shown in the figures, because the usual digital filter is provided with delay circuits D, D, . . . , it is not possible to avoid having a predetermined delay characteristic. In other words, it is not possible to enlarge the coefficients k1, k2, etc. relating to the signal to be initially outputted from the filter according to the frequency characteristics which should be expressed (this is the result with a low-pass filter, etc.). The practical output timing of a filter is substantially carried out at the timing when all coefficients k1, k2, . . . kn, are supplied and at that point the filter characteristic is determined.

Accordingly, in the present application, not only is the delay time of the filter taken into consideration, but also included is the effect of matching the rise period of the envelope to the period during which the essential effects of the filter (filter characteristics) are being made to operate.

Furthermore, in the case of an IIR type digital filter as well, it is on occasion not possible to enlarge coefficient a1 or b1, as is the case in the above FIR type digital filter. Accordingly, in this case as well, the practical output timing of the filter is at the timing all coefficients a1, a2, . . . are provided. Because the filter characteristics of the filter have been decided at this point, the effect of matching the rise period of the envelope to the period during which the essential effects of the filter (filter characteristics) are being made to operate exists.

Figure 6:
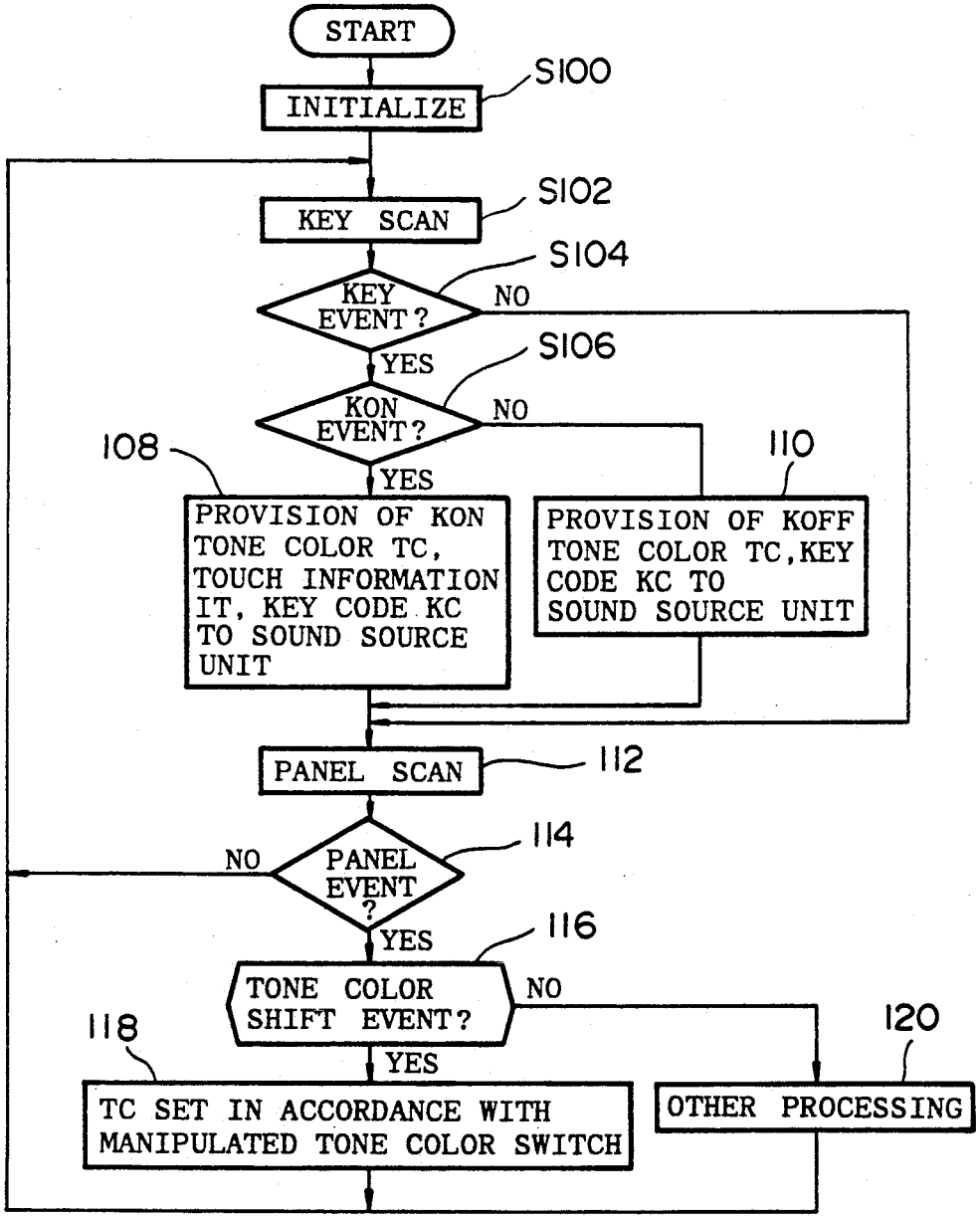
FIG. 6 is a flow chart showing the CPU disposition means of the preferred embodiment of the present invention.

Next, the operations according to the organization detailed above will be explained with reference to the flow chart shown in FIG. 6. FIG. 6 is a processing flow chart executed by CPU 2. When power is supplied by the user, CPU 2 starts from step S 100. At step S 100, initialization of each variable and peripheral circuits is carried out. Next, at step S 102, key scanning is carried out by way of key board interface la, obtaining each key state. Next, at step S 104, judgment is made on whether there are any key events or not. Then, in the case where the judgment made at step S 104 is [YES], the processing proceeds to step S 106. At step 106, judgment is made as to whether the key event is a key-on event. In the case where the judgment made at step S 106 is [YES]—in other words, in the case where there is a key-on event—the processing proceeds to step S 108. At step S 108, as disposition for sounding, key-on signal KON, tone color TC, touch information IT and key code KC are provided to sound source unit 6.

In the case where the judgment received at step S 106 is [NO]—in other words when the event is a key-off event—the processing proceeds to step S 110. At step S 110, as disposition for the completion of sounding, key-off signal KOFF (the signal which over turns the key-on signal, or in other words a key-on signal KON of a "0" status), tone color TC and key code KC are provided to sound source unit 6. Then, in the case where the processing of step S 108 or step S 110 is completed, or in the case where the judgment received at step S 104 is [NO], the processing proceeds to step S 112. At step 112, scanning of operation panel 5 is carried out via panel interface 5*a*. Next, at step S 114, judgment is made as to whether an event has occurred or not. Next, in the case where the judgment received at step S 114 is [YES]—in other words when an event is judged to have occurred—step S 116 is proceeded to. At step S 116, judgment is made as to whether a tone color switching event has occurred or not. In the case where the judgment received at step S 116 is [YES], step 118 is proceed to. At step 118, tone color TC is set in accordance with the altered tone color switch.

At sound source unit 6, a delayed key-on KOND is generated in response to the above key-on signal KON, tone color TC, touch information IT and key cord KC. An envelope is superimposed according to this delay key on signal KOND and the rise period of the envelope is matched to the period during which the essential effects of the filter (filter characteristics) are being made to operate.

In the case where the judgment received at step S 116 is [NO]—in other words in the case where no tone color switching event has occurred—step S 120 is proceeded to. At step S 120, other dispositions are executed. Then, following completion of step S 118 or step S 120, step S 102 is returned to.

Through the repetition of the dispositions from step S 102 to step S 120 as above, the generation of musical tone and the establishment of other tone colors is carried out.

Additionally, although in the above preferred embodiments the delay time of the KON was an example preset by a logic circuit, it is also possible to utilize the register of the comparator to freely do the same. In the case where this type of organization is utilized, for example in response to a filter coefficient set by the user, it is possible for CPU 2 to calculate the delay time and set the register, and set a correct delay time corresponding to the filter characteristics.

What is claimed is:

1. An electronic musical instrument comprising:

a musical tone signal synthesizing means for generating a musical tone signal in accordance with performance information;

a filter means for providing predetermined frequency characteristics to said musical tone signal;

a filter information generating means for generating filter information based on said performance information to impart said predetermined frequency characteristics and providing said filter information to said filter means;

a delay information generating means for generating delay information corresponding to a propagation delay time of said filter means in accordance with said filter information and said performance information;

an envelope generating means for generating an envelope whose amplitude begins increasing at a timing determined by said delay information; and an envelope imparting means for imparting said envelope to said musical tone signal which is provided with said frequency characteristics.

2. An electronic musical instrument in accordance with claim 1, wherein said performance information contains a key-on signal, a tone color number, an initial touch information, and a key code.

3. An electronic musical instrument in accordance with claim 1, wherein said delay information generating means comprises a loop circuit.

4. An electronic musical instrument in accordance with claim 1, wherein said filter means comprises a finite impulse response filter.

5. An electronic musical instrument in accordance with claim 1, wherein said filter means comprises an infinite impulse response filter.

6. An electronic musical instrument in accordance with claim 1, wherein said envelope imparting means comprises a multiplier which multiplies said musical signal by said envelope which is delayed in accordance with said delay information.

7. An electronic musical instrument in accordance with claim 2, wherein said musical tone signal synthesizing means generates said musical signal based on said tone color number, said initial touch information, and said key code, when said key-on signal is positive.

8. An electronic musical instrument in accordance with claim 3, wherein fixed data circulates in said loop circuit and is incremented one by one, such that when said fixed data reaches a target data in accordance with said filter information, said delay information is outputted to said envelope generating means.

9. A method of delaying the beginning of a musical waveform envelope, comprising the steps of:

synthesizing a musical tone signal in accordance with performance information;

providing predetermined frequency characteristics to said musical tone signal with a filter;

generating filter information based on said performance information to impart said predetermined frequency characteristics to said musical tone signal;

providing said filter information to said filter;

generating delay information corresponding to a propagation delay of said filter in accordance with said filter information and said performance information;

generating an envelope whose amplitude begins increasing at a timing determined by said delay information; and imparting said envelope to said musical tone provided with said frequency characteristics.

* * * * *